US008636333B2

(12) United States Patent
Sturm et al.

(10) Patent No.: US 8,636,333 B2
(45) Date of Patent: Jan. 28, 2014

(54) PRINTER WITH COOLING FOR INKJET PRINT HEADS, AND METHOD FOR THIS

(75) Inventors: Johannes Sturm, Munich (DE); Andreas Mueller, Baldham (DE); Andreas Geishauser, Munich (DE)

(73) Assignee: Océ Printing Systems, GmbH, Poing (DE)

( * ) Notice: Subject to any disclaimer, the term of this patent is extended or adjusted under 35 U.S.C. 154(b) by 162 days.

(21) Appl. No.: 13/291,640

(22) Filed: Nov. 8, 2011

(65) Prior Publication Data

US 2012/0113182 A1 May 10, 2012

(30) Foreign Application Priority Data

Nov. 8, 2010 (DE) ..... 10 2010 060 418

(51) Int. Cl.

| | |
|---|---|
| ***B41J 29/38*** | (2006.01) |
| ***B41J 29/377*** | (2006.01) |
| ***B41J 29/393*** | (2006.01) |
| ***B41J 29/13*** | (2006.01) |

(52) U.S. Cl.

USPC ..... 347/18; 347/17; 347/19; 347/108

(58) Field of Classification Search

USPC ..... 347/17–19, 108

See application file for complete search history.

(56) References Cited

U.S. PATENT DOCUMENTS

| | | | | |
|---|---|---|---|---|
| 4,704,620 | A | 11/1987 | Ichihashi et al. | |
| 5,175,563 | A * | 12/1992 | Fushimoto et al. | 347/172 |
| 5,936,646 | A | 8/1999 | Kenny et al. | |
| 7,458,677 | B2 * | 12/2008 | Morris et al. | 347/108 |
| 2007/0071485 | A1 | 3/2007 | Yuasa | |
| 2009/0109269 | A1 * | 4/2009 | Rufes et al. | 347/102 |
| 2009/0322824 | A1 * | 12/2009 | Hori | 347/30 |

FOREIGN PATENT DOCUMENTS

JP 2002-350988 A 12/2002

* cited by examiner

*Primary Examiner* — Jason Uhlenhake

(74) *Attorney, Agent, or Firm* — Schiff Hardin LLP

(57) ABSTRACT

In a printer for printing a recording material, a printer frame bears a printing unit with a plurality of print heads arranged substantially horizontal and transverse to a transport direction of the recording material. A distributor is provided for air and a coupling unit is arranged stationary in the printer frame and via which air is supplied to the distributor. The distributor comprises at least one cooling air segment to supply cooling air in a vertical direction to the print heads and at least one exhaust air segment to discharge heated air.

14 Claims, 8 Drawing Sheets

PRINTER WITH COOLING FOR INKJET PRINT HEADS, AND METHOD FOR THIS

BACKGROUND

The present specification concerns a printer for printing a recording material. The specification furthermore concerns an associated method.

Known printers with inkjet print heads print a recording material with ink, wherein a plurality of print heads are arranged in juxtaposition and simultaneously print regions of the recording material without the individual print heads being moved in the printing process. The print heads comprise an electronic activation element whose power loss heats the print heads and the ink that is used. In order to not exceed the operating temperatures required for the print heads and for the ink that is used, the thermal energy arising due to electrical power loss must be dissipated; and an air cooling is typically used for this. The air conduction can thus have a significant influence on the quality of the generated print image. Namely, it is to be ensured that the temperature of the print heads and those of the inks are as identical as possible, which can be problematic given a plurality of print heads. In high-capacity printers, multiple print heads are provided on a support plate, wherein multiple support plates whose print heads print simultaneously are arranged for fast color printing. Given an irregular air feed, the efficiency of the cooling can be different per print head. For example, if a first print head is arranged relatively close to the air intake, its cooling is improved, with the result of a low operating temperature. A print head at a distance from the air intake, as well as its ink, therefore experiences a lesser cooling and has an increased operating temperature, whereby the print quality of the print and the service life of the print heads can be negatively affected.

An additional requirement is provided with regard to the ease of service. In order to be able to conduct maintenance on the print heads, it is necessary to take corresponding design measures, wherein the mechanical elements to supply air for the cooling should interfere as little as possible.

U.S. Pat. No. 4,704,620 describes the cooling of print heads, wherein air feed and discharge blowers arranged to the sides of the print heads laterally conduct the air towards the print heads and draw heated air off again.

U.S. Pat. No. 5,936,646 describes an image development unit with a cooling device for the print head. The heat arising in the environment of a print head is hereby drawn off by a ventilator, conducted to a cooling body, and the heat is thus discharged from the print head.

SUMMARY

It is an object to specify a printer and a method in which a plurality of print heads optimally have the same operating temperature given application of an air cooling.

In a printer for printing a recording material, a printer frame bears a printing unit with a plurality of print heads arranged substantially horizontal and transverse to a transport direction of the recording material. A distributor is provided for air and a coupling unit is arranged stationary in the printer frame and via which air is supplied to the distributor. The distributor comprises at least one cooling air segment to supply cooling air in a vertical direction to the print heads and at least one exhaust air segment to discharge heated air.

DESCRIPTION OF THE PREFERRED EMBODIMENT

Figure 1:
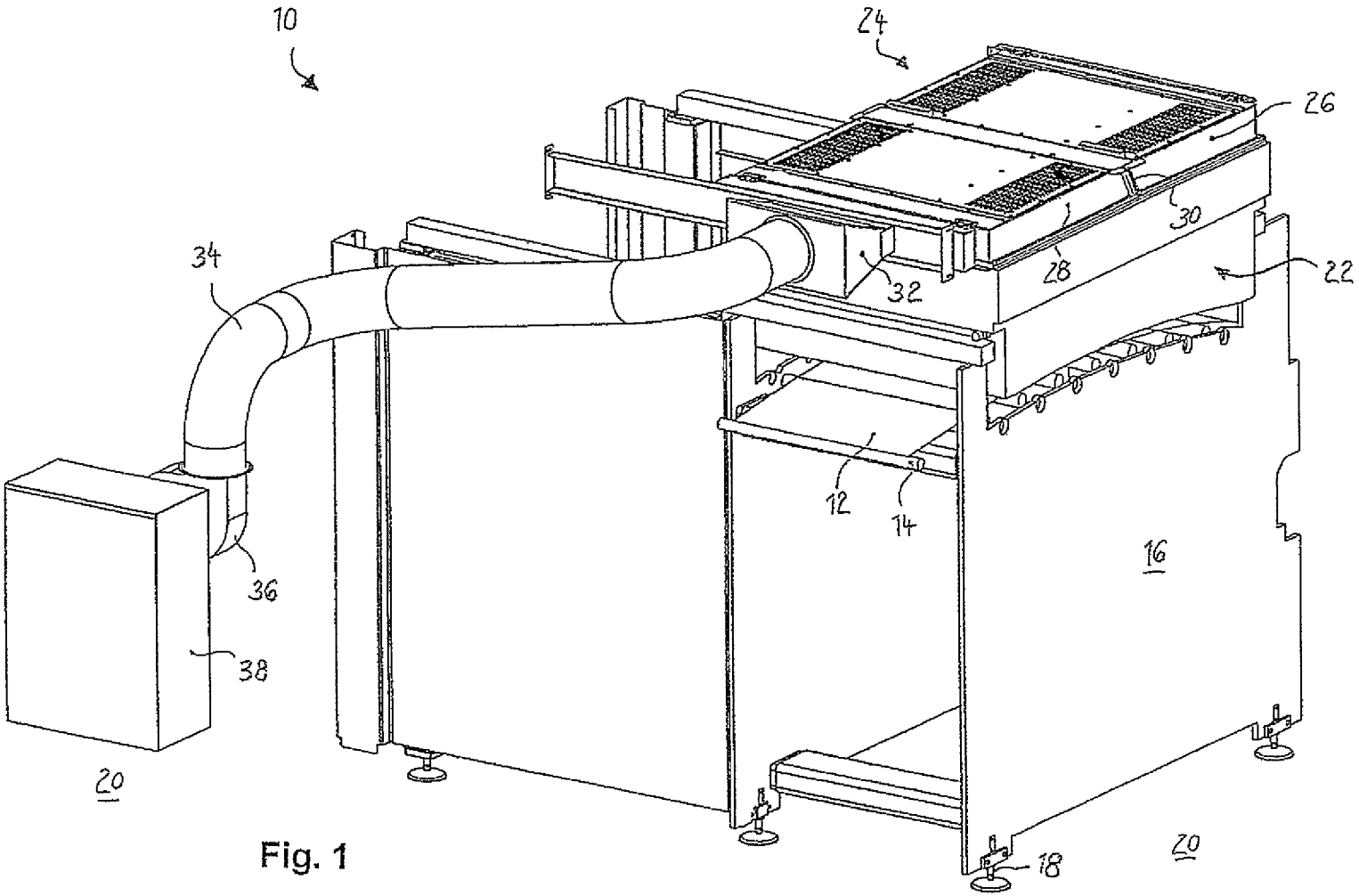
FIG. 1 is a principle presentation of a printer that obtains cooling air from the environment.

For the purposes of promoting an understanding of the principles of the invention, reference will now be made to the preferred exemplary embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In one exemplary embodiment, the plurality of print heads is combined into a printing unit. The print heads are essentially distributed in the horizontal direction within the print unit. Air for cooling can be supplied to a distributor via a coupling unit. This distributor comprises a cooling air segment from which the air is conducted in the vertical direction to the plurality of print heads. Moreover, the distributor comprises at least one exhaust segment which takes up and discharges heated air.

The supply of cooling air in the vertical direction to the print heads ensures a uniform cooling of the print heads so that a largely consistent operating temperature appears at them. The heated air (also designated as exhaust air) is taken up and discharged by the exhaust segment. The danger of an air stall is thereby reduced, which facilitates a uniform cooling of the print heads.

According to one exemplary embodiment, the distributor is connected with the printing unit, which is movable from a printing position into a park position, for example transverse to the transport direction of the recording material, in the park position the distributor is separated from the coupling unit. In this embodiment the distributor (which supplies the cooling air and discharges the exhaust air) is thus moved together with the printing unit relative to the printer frame, such that the print heads and the design elements for air cooling have a compact design. In the park position a cooling of the print heads is not required, such that the distributor can be separated from the coupling unit in this position. This coupling unit that supplies the cooling air to the distributor is connected in a stationary manner with the printer frame, such that—on the one hand—a compact design that is advantageous for both the printing position and the park position is achieved via this distribution of the required cooling elements, and on the other hand it enables an easier access to the print heads in the park position.

An additional exemplary embodiment provides that the distributor forms a cover for the printing unit that enables access from above to the print heads in the opened state. The distributor can accordingly enable an access to the print heads via displacement, pivoting or removal, such that it on the one hand forms a compact unit with the printing unit in the closed state of the cover and on the other hand facilitates the maintenance in the open state of the cover.

According to a first variant, fresh air is supplied to the distributor from outside the printer. In particular, the fresh air is drawn from the environment near the floor on which the printer stands. The fresh air supply from the floor environment is advantageous because this air is cooler than in the head area of the printer. The use of environment air for cooling leads to a simple design in terms of construction for the entire cooling.

In a further variant, the exhaust air (i.e. air heated by the print heads) is supplied via the distributor and the coupling element to at least one heat exchanger that cools the exhaust air. This cooled air is supplied to the cool air segment of the distributor. This variant can also be executed as a closed circuit, wherein no additional air is drawn from the environment.

According to a further aspect of the one exemplary embodiment, a method is specified for cooling print heads in a printer. The advantages that can be achieved with this method coincide with the advantages described in the preceding.

Exemplary embodiments are explained in the following using the drawing figures wherein identical parts respectively have the same reference characters.

FIG. 1 shows the principle design of a printer 10 in which an exemplary embodiment is realized. It is thus a high-capacity printer that prints water-based ink onto a web-shaped recording material 12 according to the inkjet principle. This recording material 12—generally a paper web—is transported in an approximately horizontal direction through the printer 10, wherein it is directed on rollers 14 (only one roller is provided with the reference character 14). The rollers 14 are borne in a printer frame 16 which accommodates a plurality of groups. The printer frame 16 is supported with its apparatus feet 18 (only one apparatus foot is designated with the reference character 18) on the floor 20.

A printing unit 22 that comprises a plurality of inkjet print heads (not shown) is borne in the printer frame 16. Arranged above the printing unit 22 is a distributor 24 that provides for the distribution of air. The distributor 24 also serves as a cap or cover for the printing unit 22 and is divided into two cover parts 26, 28 that have a common interface unit 30.

The distributor 24 is connected on one side with a coupling unit 32 that is arranged stationary on the printer frame 16. Air is supplied to the distributor 24 via this coupling unit 32. In this exemplary embodiment the coupling unit 32 is connected with a flexible hose 34 for fresh air supply. The hose 34 is connected to a fresh air blower 36 which draws air from the floor region (for example from the region below the printing unit 22) across an air filter 38.

In the printer 10 shown in FIG. 1, casing parts that surround the printer frame 16 have been omitted. The air filter 38 is advantageously arranged within the printer 10 surrounded by casing parts (not shown) and draws the air through a grid-shaped opening in the floor region of the associated casing part.

Figure 2:
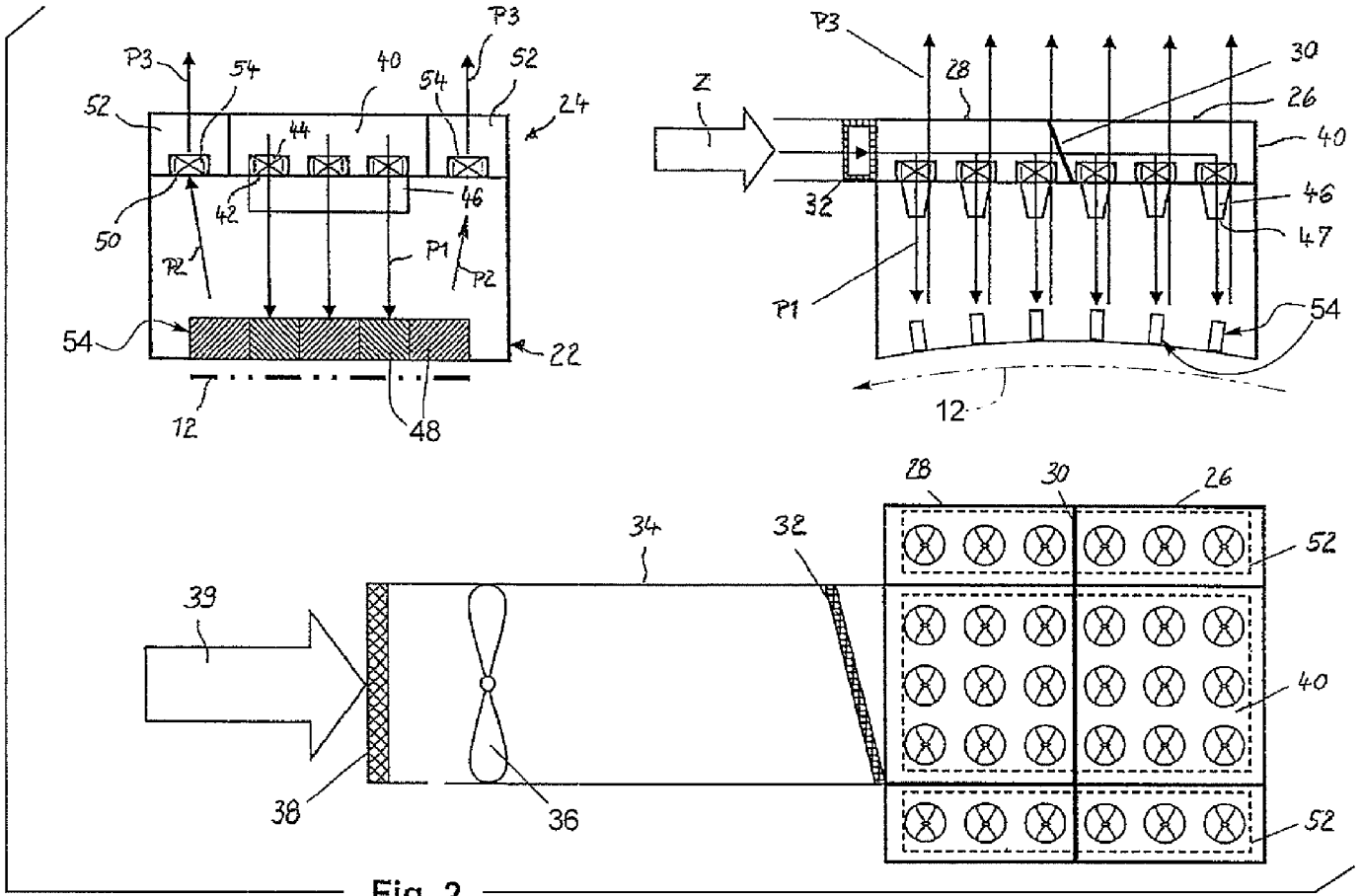
FIG. 2 is a three-part, schematic presentation of the air conduction for the example according to FIG. 1.

FIG. 2 shows a three-part schematic presentation in order to clarify the air conduction for the example according to FIG. 1. The presentation at the top left schematically shows a side view as viewed from in front of the recording material 12; the presentation to the top right shows a side view as seen from the direction transverse to the transport direction of the recording material 12; the presentation at the bottom shows a plan view from above. The printing unit 22 that is connected with the distributor 24 is apparent in the side view at the top left. The distributor 24 centrally comprises a cooling air segment 40 which is closed at the top. At the bottom the cooling air segment 40 comprises openings 42 in which a ventilator 44 is respectively comprised (only one opening 42 and one ventilator 44 are designated). These ventilators blow additional air from the cooled air segment 40 into additional air nozzles 46 that, for example, have slits as nozzle openings. This additional air or cooling air is accelerated by the ventilators 44 and the additional air nozzles 46 and vertically strikes print heads 48 in the direction P1, which print heads 48 are arranged in juxtaposition (of five drawn print heads 48, only one is designated). The additional air flows around the print heads 48 and absorbs heat that results due to the power loss of the electronics of the print heads 48. The heated air (also called exhaust air) is conducted in the direction of the arrow P2 within the printing unit 22 and is directed via openings 50 (only one opening 50 is designated) into two exhaust air segments 52 that are comprised in the distributor 22 on both sides of the cooling air segment 40. Ventilators 54 that discharge the exhaust air in an accelerated manner are comprised in the exhaust air openings 50. The exhaust air is directed upward, out of the printer 10 in the direction of the arrow P3, for example via additional openings or via a respective opening (closed with a grid) per exhaust air segment 52.

In the presentation to the top right of FIG. 2, it is apparent that the additional air Z is supplied via the stationary coupling unit 32 and is distributed in cooling air segment 40. As is explained in detail further below, the print heads 48 (here five print heads) shown to the left in the presentation are assembled into print head rows 54 (only one row 54 is designated), wherein one ink color is respectively associated with each row 54. The additional air nozzles 46 are distributed so that one additional air nozzle 46 with a slit-shaped opening 47 is associated with each row 54.

The interface unit 30 running at an angle is also recognizable in the presentation. The cover part 26 can be pivoted to the right and the cover part 28 can then be pivoted to the left in order to open the distributor 24. The interface unit 30 comprises a soft, orbiting seal so that both the cooling air segment 40 and the two exhaust air segments 52 form continuous hollow spaces in the closed state.

In the plan view according to the lower presentation in FIG. 2, it is apparent that a large-area air filter 38 filters air 39 from near the floor. Foreign bodies and dust are filtered out in this manner in order to keep them from arriving inside the printing unit 22. The coupling unit 32 likewise comprises a soft, flexible seal in order to seal the coupling unit 32 air-tight from its opposite cooling air segment 40. The various cooling air openings with the ventilators in the cooling air segment 40, and similarly the exhaust air openings and the ventilators in the exhaust air segments 52, are apparent in the plan view.

Figure 3:
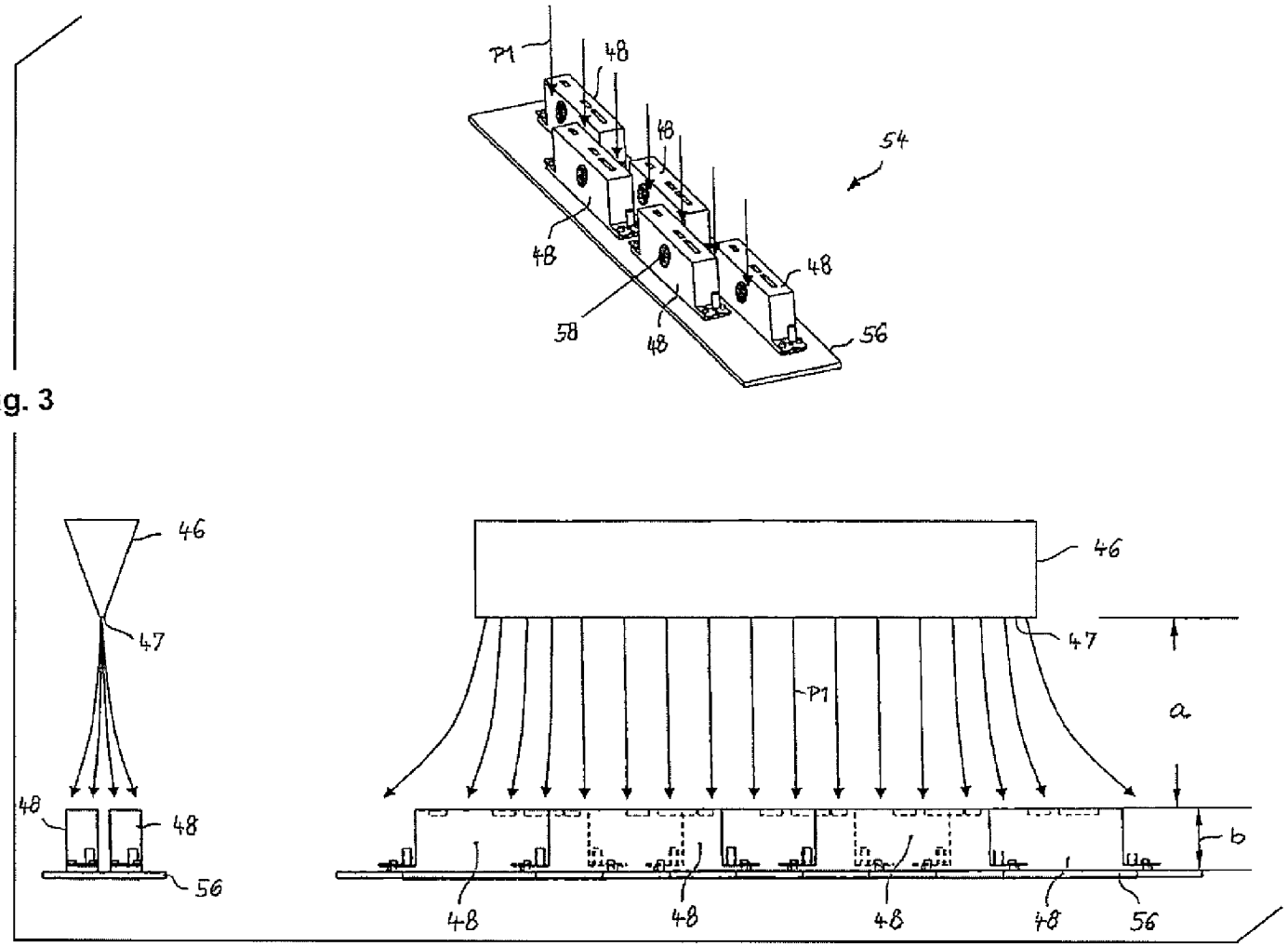
FIG. 3 is a three-part, schematic presentation of the conduction of the cooling air.

In three schematic presentations, FIG. 3 shows the feed of cooling air (and in perspective in the upper part of the image, in fact) a print head row 54 at which multiple print heads 48 are arranged on a support plate 56. These print heads 48 comprise in a respective housing electronic modules—in particular power electronics that generate waste heat—that form heat sources 58 (only one is designated). The cooling air arriving vertically in direction P1 is heated by the heating sources 58 and thermal energy is dissipated. The additional air nozzle 46 is shown in the lower image portion, which additional air nozzle 46 supplies the additional air in an essentially vertical direction P1 so that all print heads 48 of the row of print heads associated with the additional air nozzle 46 are cooled. In the left part of the image, the additional air nozzle 46 is shown with its slit-shaped opening 47. The support plate 56 is movable in the vertical direction in the printing unit 22 such that the distance a between nozzle opening 47 and print heads 48 can vary. A minimum distance is chosen so that sufficient space in order to also avoid a contact upon pivoting of the cover parts 26, 28 remains between the nozzle opening 47 and upper boundary of the print heads 48, even in the raised position of the support plate 56.

Figure 4:
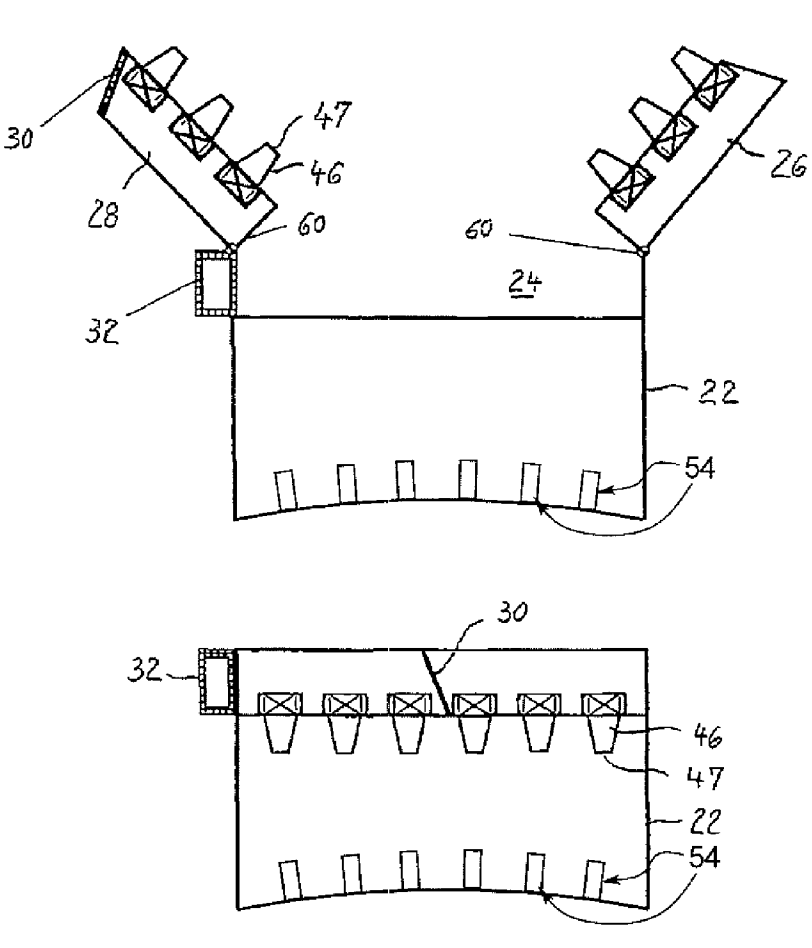
FIG. 4 shows two operating states of the distributor.

FIG. 4 schematically shows two states of the distributor 24. As mentioned, in one exemplary embodiment the distributor 24 is divided into two cover parts 26, 28 that are connected with the printing unit 22 such that they can rotate via swivel joints 60. The interface unit 30 is connected with a cover part 28. In the closed state—as shown in the lower part of the image—the interface unit 30 connects both cover parts 24, 26 so that continuous hollow spaces are formed along the length of the distributor 24.

Figure 5:
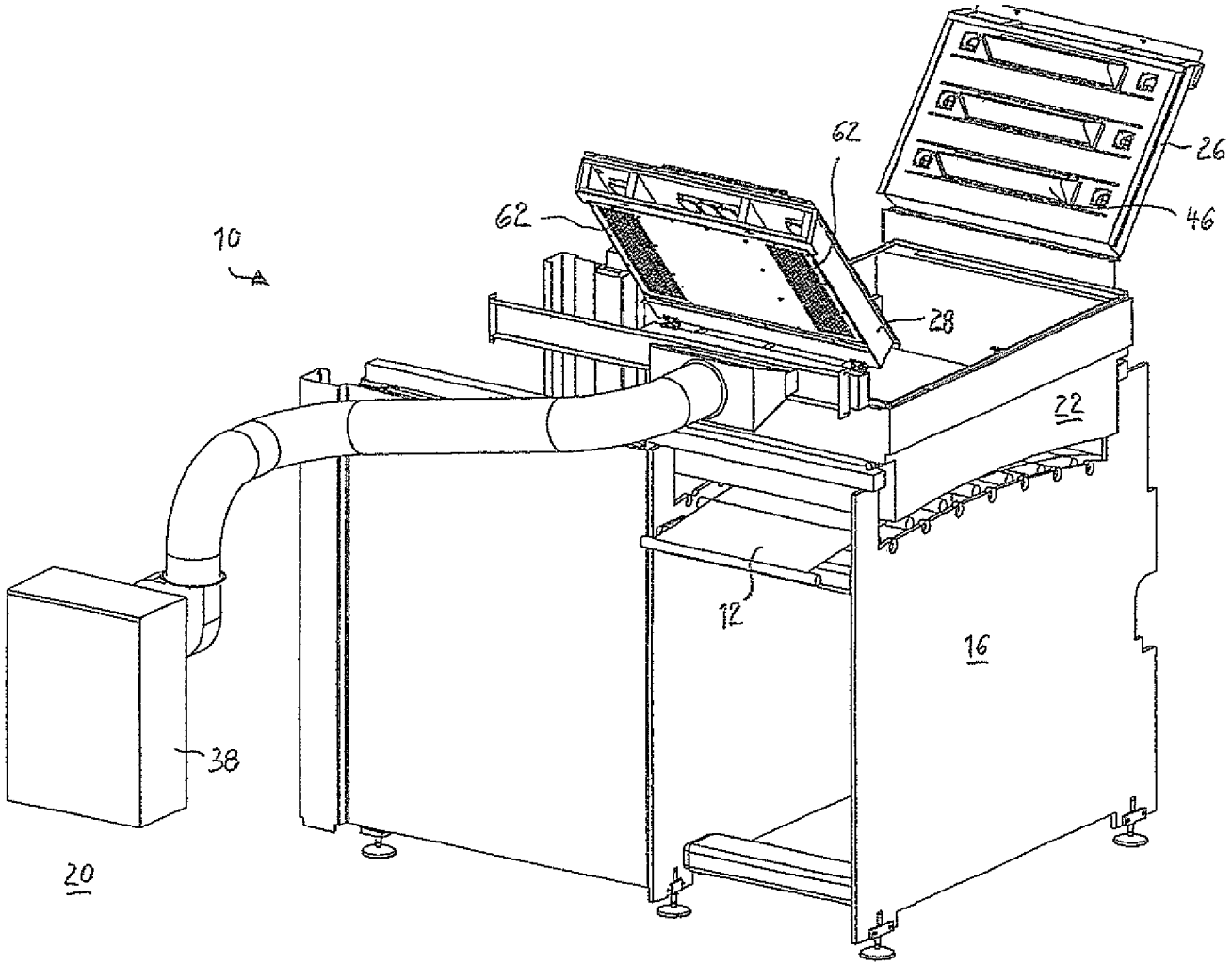
FIG. 5 is the printing unit in a normal operating position, with opened cover parts.

FIG. 5 shows the printer 10 in the normal operating position in which the printing unit 22 is located above the recording material 12. The cover parts 26, 28 are folded up so that, in this position, access to the inside of the printing unit 22 and to the print heads 48 is possible. It is apparent in FIG. 5 that three additional air nozzles 46 with slit-shaped openings are provided per cover part 26, 28. The exhaust air exits via air grid 62.

Figure 6:
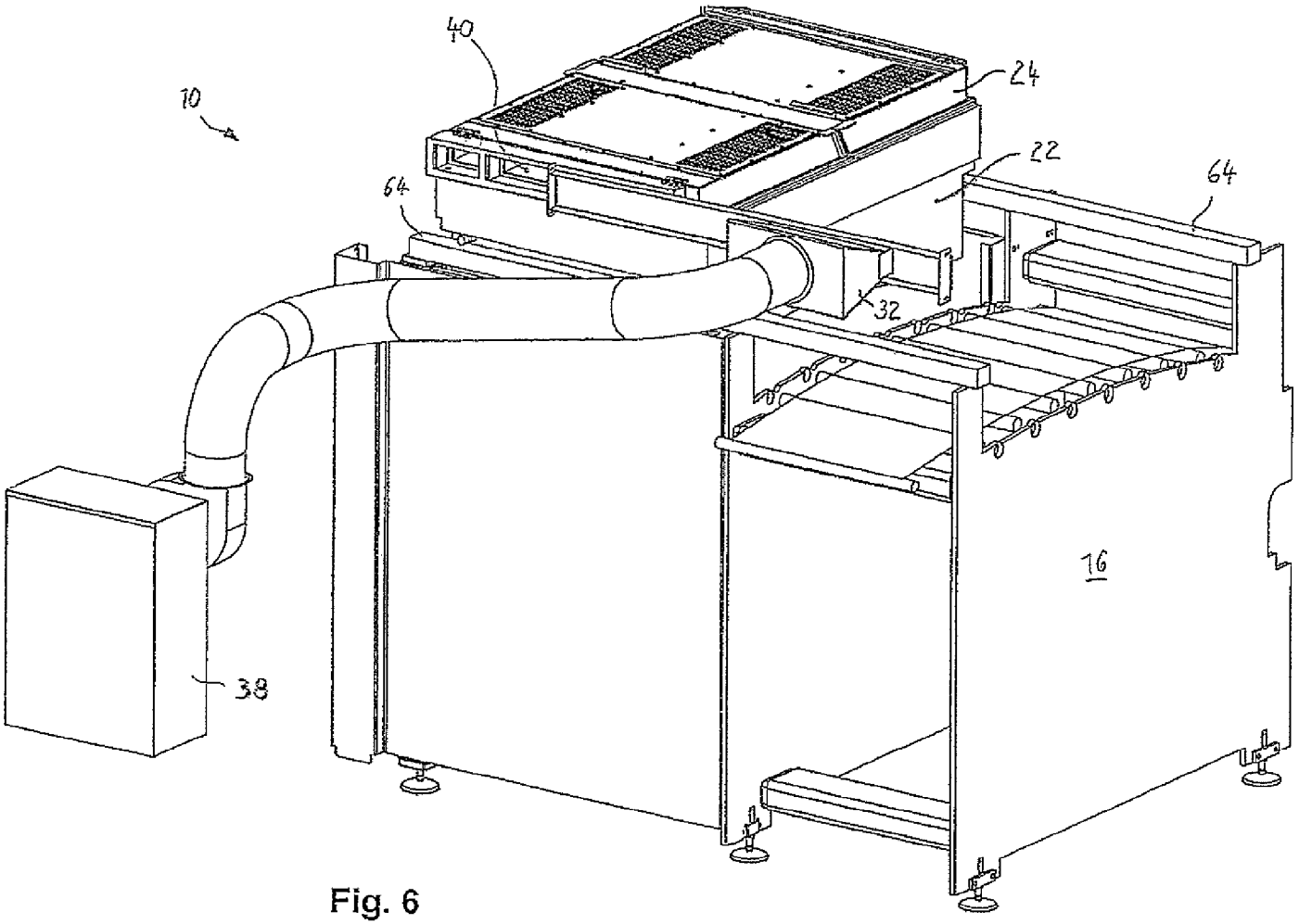
FIG. 6 shows the printing unit in a park position.

FIG. 6 shows the printer 10 in which the printing unit 22 is located in a park position in which the print heads do not print. The printing unit 22, together with the distributor 24, is shifted transverse to the recording material 12 along guides 64. In this state the coupling unit 32 is not connected with the cooling air segment 40 and does not deliver any cooling air.

Figure 7:
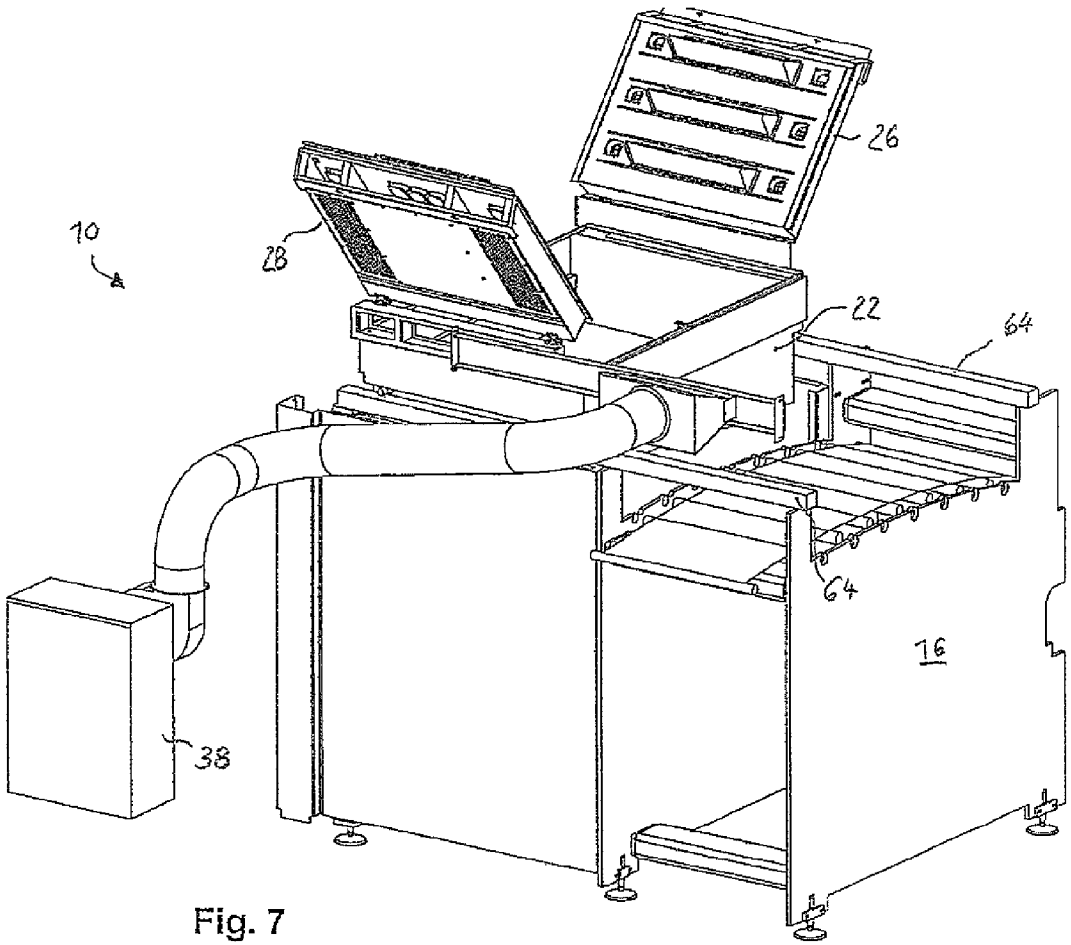
FIG. 7 illustrates the distributor with opened cover parts.

FIG. 7 shows the distributor 24 with opened cover parts 26, 28. In this position the inside of the printing unit 22 and in particular the print heads can be accessed.

Figure 8:
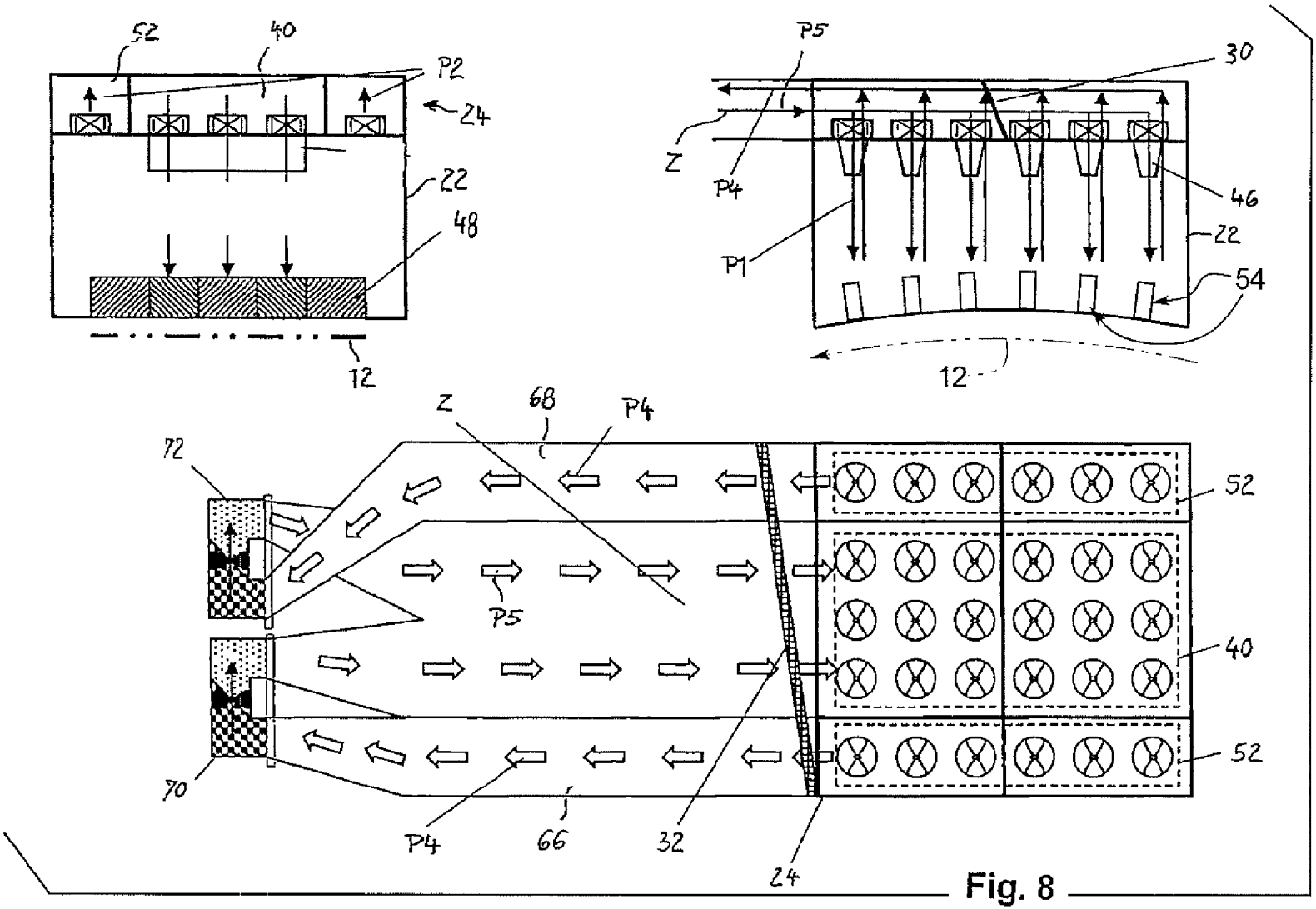
FIG. 8 is a three-part, schematic presentation for a closed air conduction with heat exchangers.

In a three-part schematic presentation similar to FIG. 2, FIG. 8 shows a variation in which the exhaust air is not directed to the outside via openings in the top side of the distributor 24; rather, the exhaust air segments 52 are sealed at the top and conduct the exhaust air in the arrow direction P4 and, via corresponding openings, into the coupling unit 32 via tubes 66, 68 or shafts to two heat exchangers 70, 72 with blowers integrated into them. These heat exchangers 70, 72 extract heat from the exhaust air and supply it to a cooling medium. The exhaust air that is now cooled is supplied to the cooling air segment 40 as additional air Z in the arrow direction P5 via a tube or a shaft and the coupling point 32, and from there is supplied vertically to the print heads for cooling. The air thus circulates in a closed system. This has the additional advantage that the circulating air is free of foreign bodies and ink vapor.

The described exemplary embodiments can be modified in numerous ways. The flexible tube 34 shown in FIG. 1 can also be replaced by a permanently installed shaft for fresh air supply. The shown interface unit 30 is provided with a soft seal which is in the position to compensate for attitude tolerances of the two cover parts 26, 28 relative to one another. For reasons of advantageous kinematics, the interface unit is designed slanted, whereby simple and cost-effective swivel joints can be used. Alternatively, the distributor can comprise a single part which is linked to the printing unit 22 on one side in order to be pivoted as a one-part cover. Furthermore, it is possible to subdivide the distributor into more than two parts in order to allow an access to the inside of the printing unit. The coupling unit 32 can also have a different form instead of a slanted coupling surface. In order to minimize shear forces occurring at the coupling surface with the distributor, the contact surface can be provided with a friction-reducing textile coating. The air within the distributor and the printing unit advantageously has an overpressure relative to the environment so that the penetration of dust, ink vapor or foreign bodies into the printer is avoided.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

We claim as our invention:

1. A printer for printing a recording material, comprising:

a printer frame which bears a printing unit with a plurality of print heads arranged in a substantially horizontal direction transverse to a transport direction of the recording material;

a distributor for air;

a coupling unit arranged stationary in the printer frame and via which air can be supplied to the distributor;

the distributor comprising at least one cooling air segment to supply cooling air in a direction towards the plurality of print heads; and the distributor being connected with the printing unit wherein said printing unit can be moved from a printing position into a park position in a direction transverse to the transport direction of the recording material, and wherein in the park position the distributor is separate from the coupling unit.

2. The printer according to claim 1 wherein the distributor forms a cover for the printing unit that enables access from above to the print heads in an opened state.

3. The printer according to claim 1 wherein the cooling air segment comprises a plurality of cooling air openings that supply the cooling air to the plurality of print heads, and wherein the exhaust air segment comprises a plurality of exhaust air openings via which heated air is conducted out of the printing unit.

4. The printer according to claim 3 wherein the cooling air openings comprise ventilators in the cooling air segment to accelerate air flow.

5. The printer according to claim 1 wherein the distributor is connected with the coupling unit such that it is air-tight and detachable.

6. The printer according to claim 1 wherein the exhaust air openings in the exhaust air segment comprise ventilators to accelerate air flow.

7. The printer according to claim 1 wherein an additional air nozzle to align and accelerate air flow is associated with respective cooling air openings.

8. The printer according to claim 1 wherein a fresh air blower is provided to draw fresh air from an environment outside of the printer.

9. The printer according to claim 8 wherein the fresh air blower draws air from a floor region of the environment outside of the printer.

10. A printer for printing a recording material, comprising:

a printer frame which bears a printing unit with a plurality of print heads arranged in a substantially horizontal direction transverse to a transport direction of the recording material;

a distributor for air;

a coupling unit arranged stationary in the printer frame and via which air can be supplied to the distributor;

the distributor comprising at least one cooling air segment to supply cooling air in a direction toward the plurality of print heads;

the distributor forming the cover for the printing unit that enables access from above to the print heads in an opened state; and the distributor being divided into at least two cover parts that can be folded away from one another and, in a closed state, are connected with one another via an interface unit.

11. A printer for printing a recording material, comprising:

a printer frame which bears a printing unit with a plurality of print heads arranged in a substantially horizontal direction transverse to a transport direction of the recording material;

a distributor for air;

a coupling unit arranged stationary in the printer frame and via which air can be supplied to the distributor;

the distributor comprising at least one cooling air segment to supply cooling air in a direction towards the plurality of print heads; and exhaust air being connected with at least one heat exchanger that supplies cooled air to the distributor.

12. The printer according to claim 11 wherein the air circulates in the heat exchanger, in the distributor, and in the printing unit in a closed system.

13. A method to cool print heads in a printer, comprising the steps of:

providing a printing unit with a plurality of print heads distributed in a substantially horizontal direction in a printer frame;

supplying with a coupling unit arranged stationary at the printing frame air to a distributor;

supplying cooling air with the distributor in at least one cooling air segment towards the plurality of print heads; and connecting the distributor with the printing unit wherein said printing unit can be moved from a printing position into a park position in a direction transverse to the transport direction of the recording material, and wherein in the park position the distributor is separate from the coupling unit.

14. A printer for printing a recording material, comprising:

a printer frame which bears a moveable printing unit with a plurality of print rows and wherein each row has a plurality of print heads and wherein each row has a longitudinal extent in a substantially horizontal direction transverse to a transport direction of the recording material;

a distributor for air above and resting on the printing unit;

a coupling unit arranged stationary in the printer frame and via which air can be coupled to the distributor when the printing unit is in a printing position and decoupled from the printing unit when the printing unit is moved laterally away from the recording material in a park position;

the distributor comprising at least one cooling air central control segment to supply cooling air in a direction towards the plurality of print rows with the print heads and at least two exhaust air segments to discharge heated air in a second substantially opposite direction, and wherein the central control segment lies between the two exhaust segments, said exhaust segments lying in a region approximately above ends of a longitudinal extent of the print head rows, said central segment lying substantially centered above the print head rows; and the distributor being connected with the printing unit wherein said printing unit can be moved from a printing position into a park position in a direction transverse to the transport direction of the recording material, and wherein in the park position the distributor is separate from the coupling unit.

* * * * *